US010047641B2

(12) United States Patent
Oka et al.

(10) Patent No.: US 10,047,641 B2
(45) Date of Patent: Aug. 14, 2018

(54) ROLLER LIFTER

(71) Applicant: OTICS CORPORATION, Nishio-shi, Aichi (JP)

(72) Inventors: Hideki Oka, Nishio (JP); Hiroki Fujii, Nishio (JP); Naoyuki Yamane, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 80 days.

(21) Appl. No.: 15/313,353

(22) PCT Filed: May 13, 2015

(86) PCT No.: PCT/JP2015/063718

§ 371 (c)(1),
(2) Date: Nov. 22, 2016

(87) PCT Pub. No.: WO2015/194289

PCT Pub. Date: Dec. 23, 2015

(65) Prior Publication Data

US 2017/0191384 A1 Jul. 6, 2017

(30) Foreign Application Priority Data

Jun. 20, 2014 (JP) ..... 2014-126866

(51) Int. Cl.
*F01L 1/14* (2006.01)
*F01L 1/00* (2006.01)

(52) U.S. Cl.
CPC .. *F01L 1/14* (2013.01); *F01L 1/00* (2013.01)

(58) Field of Classification Search
CPC ..... F01L 1/14; F01L 1/00
(Continued)

(56) References Cited

U.S. PATENT DOCUMENTS 8,235,018 B2 * 8/2012 Dorn ..... F01L 1/14 123/90.48
2008/0190237 A1 8/2008 Radinger et al.
(Continued)

FOREIGN PATENT DOCUMENTS

JP 05-288015 A 11/1993
JP 06-159016 A 6/1994
(Continued)

OTHER PUBLICATIONS

International Preliminary report on Patentability for PCT/JP2015/063718 dated Apr. 28, 2016 (with English translation).
(Continued)

*Primary Examiner* — Zelalem Eshete
(74) *Attorney, Agent, or Firm* — Smith, Gambrell & Russell, LLP

(57) ABSTRACT

An object is to provide a roller lifter which can maintain a proper dimensional accuracy of an outer diameter. A shaft (25) rotatably supporting a roller (30) is inserted through a pair of opposed portions (21) and swaged to be fixed. A cylindrical portion (61) is disposed to be fixed at a relative position to the opposed portions (21). Upon rotation of a cam (90), the cylindrical portion (61) is reciprocated via the roller (30). The roller lifter (10) includes a first member (20) in which the shaft (25) is swaged to be fixed to the opposed portions (21) and a second member (60) separate from the first member (20) and couplable via a coupling member to the first member (20). The second member (60) includes at least the cylindrical portion (61).

5 Claims, 12 Drawing Sheets

(58) Field of Classification Search
USPC ..... 123/90.48
See application file for complete search history.

(56) References Cited

U.S. PATENT DOCUMENTS

| | | | |
|---|---|---|---|
| 2012/0125277 | A1 | 5/2012 | Chambonneau et al. |
| 2013/0340965 | A1 | 12/2013 | Yook et al. |
| 2015/0082938 | A1 | 3/2015 | Schick |

FOREIGN PATENT DOCUMENTS

| | | | |
|---|---|---|---|
| JP | 2010-511834 | A | 4/2010 |
| JP | 2011-163253 | A | 8/2011 |
| JP | 2013-217304 | A | 10/2013 |
| JP | 2014-001706 | A | 1/2014 |
| WO | 2013/119214 | A1 | 8/2013 |

OTHER PUBLICATIONS

International Search Report for PCT/JP2015/063718, dated Jul. 14, 2015 in English and Japanese Language.

* cited by examiner

ROLLER LIFTER

TECHNICAL FIELD

The present invention relates to a roller lifter.

BACKGROUND ART

Patent Document 1 discloses a roller lifter including a roller brought into contact with a cam, a shaft (a support pin) rotatably supporting the roller and a pair of opposed portions (a pair of supports) through which both ends of the shaft are inserted and swaged to be fixed, respectively. Both opposed portions are formed integrally with a cylindrical portion (a lifter body). The cylindrical portion is reciprocated via the roller in an up-down direction in a cylinder head. The cylindrical portion has an outer periphery serving as a sliding surface which is slid on an inner periphery of the cylinder head. The outer periphery of the cylindrical portion requires a strict dimensional control in order to be smoothly slidable without backlash in the cylinder head.

PRIOR ART DOCUMENT

Patent Documents

Patent Document 1: Japanese Patent Application Publication No. JP-A-2014-1706

SUMMARY OF THE INVENTION

Problem to be Overcome by the Invention

In the above-described conventional roller lifer, however, the opposed portions sometimes fall inward so as to come closer to each other since outer surfaces of the opposed portions are subjected to high pressure during the swaging of the shaft. If the opposed portions are deformed, an outer peripheral wall of the cylindrical portion, which is integrally continuous from the opposed portions, would also be deformed with high possibility, with a result that an outer diameter of the cylindrical portion could not be maintained in a proper dimensional accuracy.

The present invention was made in view of the foregoing circumstances, and an object thereof is to provide a roller lifter which can maintain the outer diameter in a proper dimensional accuracy.

Means for Overcoming the Problem

A roller lifter according to the present invention includes a roller brought into contact with a cam, a shaft rotatably supporting the roller, a pair of opposed portions through which both ends of the shaft are inserted respectively, and a cylindrical portion disposed to be fixed at a relative position to the pair of opposed portions. The pair of opposed portions being opposed to each other in a right-left direction. In the roller lifter, the cam is rotated so that the cylindrical portion is reciprocated via the roller. The roller lifter comprises a first member including at least the pair of opposed portions and a second member separate from the first member and couplable via a coupling portion to the first member, the second member including at least the cylindrical portion. In the roller lifter, the first member includes a bridge portion constructed between upper ends of the opposed portions. The bridge portion has a front end and a rear end to both of which a front drooping portion and a rear drooping portion are bendingly continuous, respectively. The first member is inserted into the cylindrical portion in a normal posture while the front drooping portion and the rear drooping portion are in abutment against an inner periphery of the cylindrical portion. A pair of the front drooping portions are provided at both sides of a frontwardly projecting projection so that the projection is interposed between the pair of front drooping portions, the projection being formed to be continuous to the bridge portion in a stepless manner linearly in a front-back direction. The cylindrical portion includes a front part provided a recess open in a lower end of the cylindrical portion. The projection is fitted in the recess.

Effect of the Invention

Even though the shaft is swaged to be fixed to the paired opposed portions, the outer diameter of the cylindrical portion can be maintained in a proper dimensional accuracy without influences of the swaging of the shaft reaching the cylindrical portion when the first member including the pair of opposed portions through which the ends of the shaft are inserted is coupled to the second member including the cylindrical portion.

BEST MODE FOR CARRYING OUT THE INVENTION

Figure 1:
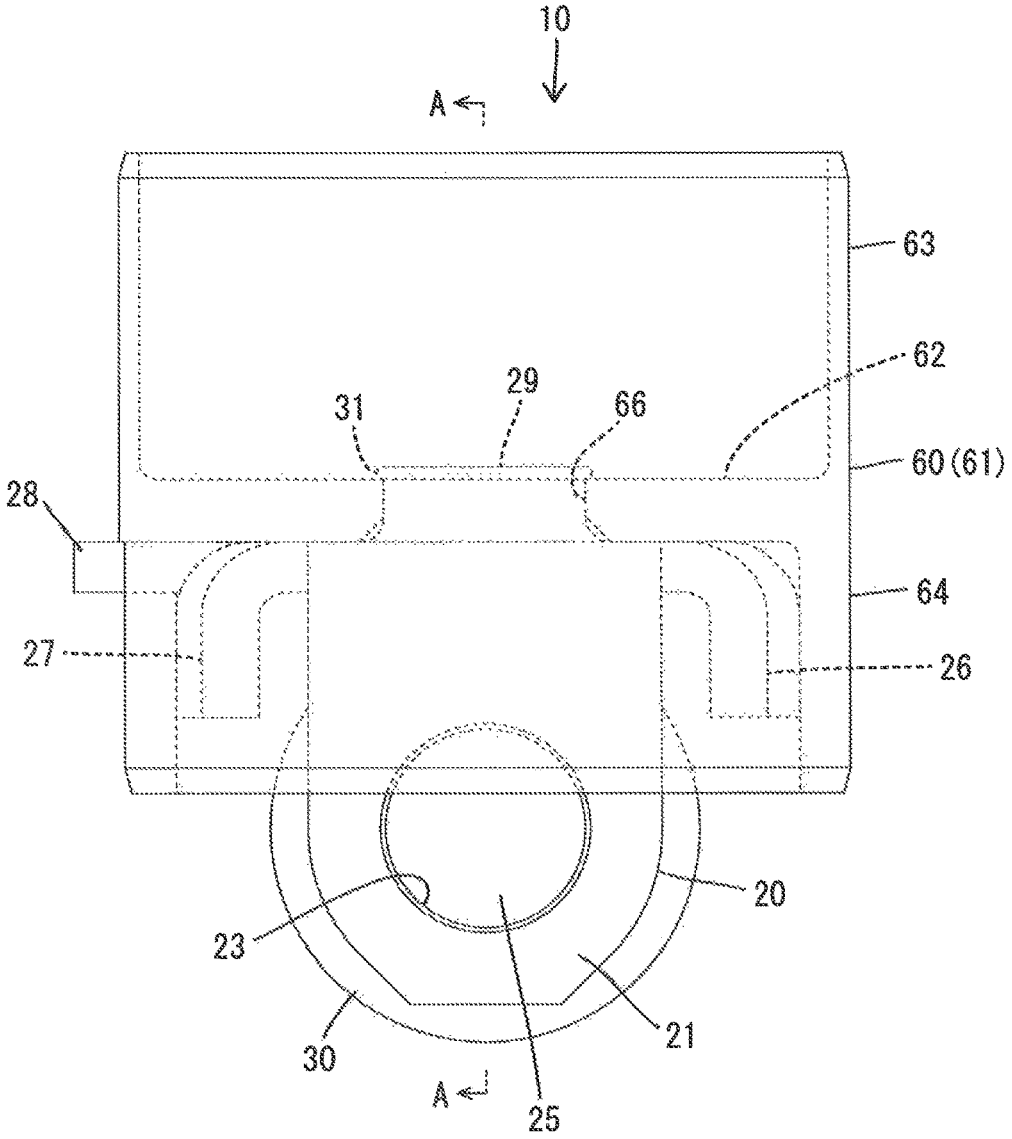
FIG. 1 is a side elevation of a roller lifter of a first embodiment according to the present invention.

Favorable forms of the present invention will be described.

The cylindrical portion has a bottom wall and a peripheral wall rising from an outer periphery of the bottom wall. The coupling portion includes a convex portion provided on either one of the bridge portion and the bottom wall and a hole provided in the other of the bridge portion and the bottom wall. The convex portion is inserted through the hole and swaged to be fixed to the other of the bridge portion and the bottom wall. Since the convex portion is provided on one of the bridge portion and the bottom wall and the hole is provided in the other of the bridge portion and the bottom wall, the influences of the swaging of the convex portion do not directly reach the cylindrical portion, with the result that the outer diameter of the cylindrical portion can be maintained in a more proper dimensional accuracy. Furthermore, since the convex portion is inserted through the hole and then swaged to be fixed to the other of the bridge portion and the bottom wall, the roller shaft can easily be manufactured and the integrity of the first and. second members can be improved.

The convex portion is provided on the bridge portion and the hole is provided in the bottom wall. Contrarily, if the convex portion is provided on the bottom wall and the hole is provided in the bridge portion, a distal end of the convex portion would possibly interfere with the roller when the convex portion is inserted through the hole, so that the roller lifter needs to be set so as to avoid such interference. This would result in an increase in the height of the roller lifter and a large limitation in the design of the roller lifter. However, when the convex portion is provided on the bridge portion and the hole is provided in the bottom wall, the distal end of the convex portion can be caused to escape inside the bottom wall having a higher design freedom.

The pair of opposed portions are provided with respective bearing holes, and the both ends of the shaft are slidably inserted into the respective bearing holes so that the shaft is rotatably supported by the opposed portions. Retaining portions are provided on outer peripheries of both end surfaces of the shaft respectively. The retaining portions protrude so as to face surrounding portions of the bearing holes respectively. According to this construction, since the ends of the shaft need not to be swaged to be fixed to the respective opposed portions, the opposed portions have less possibility of deformation with the result that the opposed portions can be maintained in a proper dimensional accuracy. Furthermore, when the shaft is rotatably supported on the opposed portions, the service life of the shaft can be improved since an area of load acting on the shaft continually changes circumferentially.

The pair of opposed portions are provided with respective bearing holes, and the both ends of the shaft are disposed so as to project outside the pair of opposed portions after having been inserted through the bearing holes, respectively. The both end surfaces of the shaft are located to be abuttable against an inner periphery of the cylindrical portion when the first member and the second member are coupled to each other. According to this construction, since the ends of the shaft need not to be swaged to be fixed to the respective opposed portions, the opposed portions have less possibility of deformation with the result that the opposed portions can be maintained in a proper dimensional accuracy. Furthermore, manufacturing costs can be reduced since no special process needs to be applied to both end surfaces of the shaft.

<First Embodiment>

Figure 3:
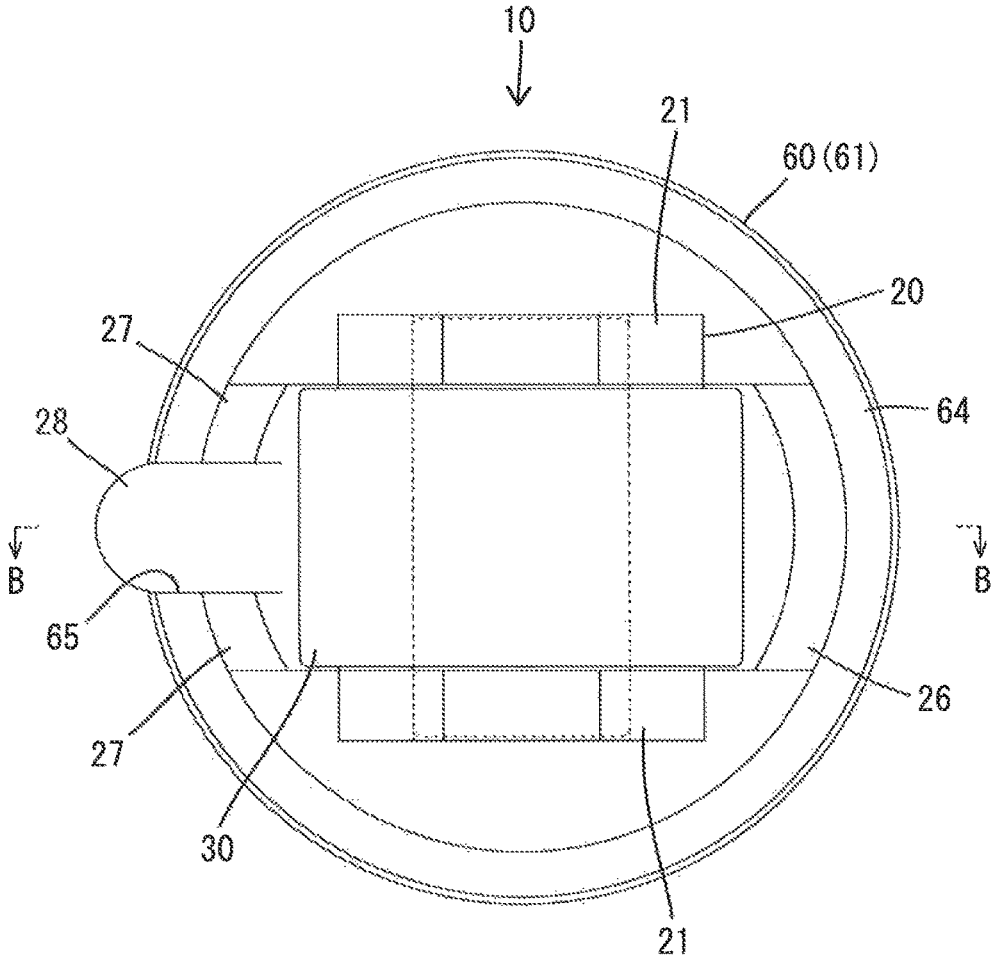
FIG. 3 is a bottom view of the roller lifter.
Figure 4:
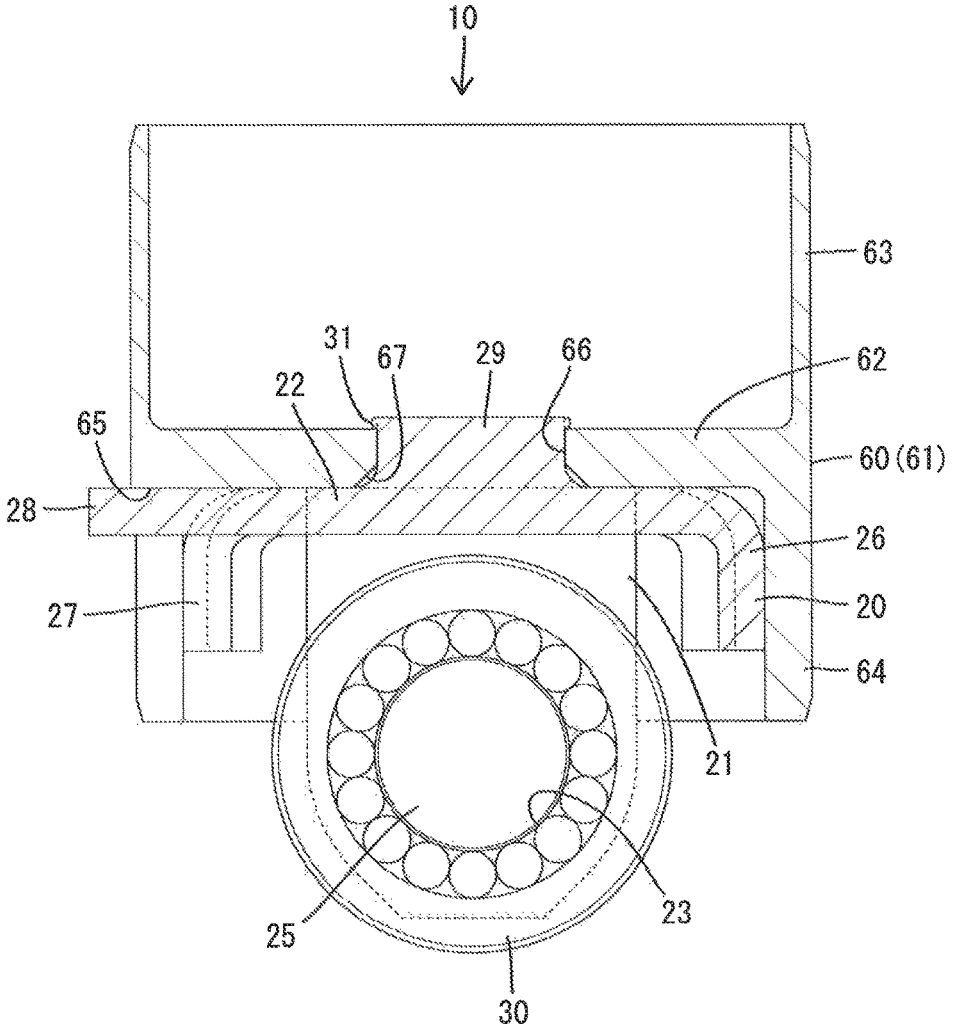
FIG. 4 is a sectional view taken along line B-B in FIG. 3.

A first embodiment of the present invention will be described with reference to the drawings. A roller lifter 10 of the first embodiment is applied to a pump lifter provided in a fuel supply system 80 of an internal combustion engine. The roller lifter 10 includes a first member 20 and a second member 60. The first and second members 20 and 60 are separate from each other and are coupled to each other via a coupling portion comprising a convex portion 29 and a hole 66 both of which will be described later. In the following description, an up-down direction is based on the views except for FIG. 3, and a left side as viewed in FIG. 4 is a front. Furthermore, a right-left direction in FIG. 2 is a widthwise direction.

Figure 2:
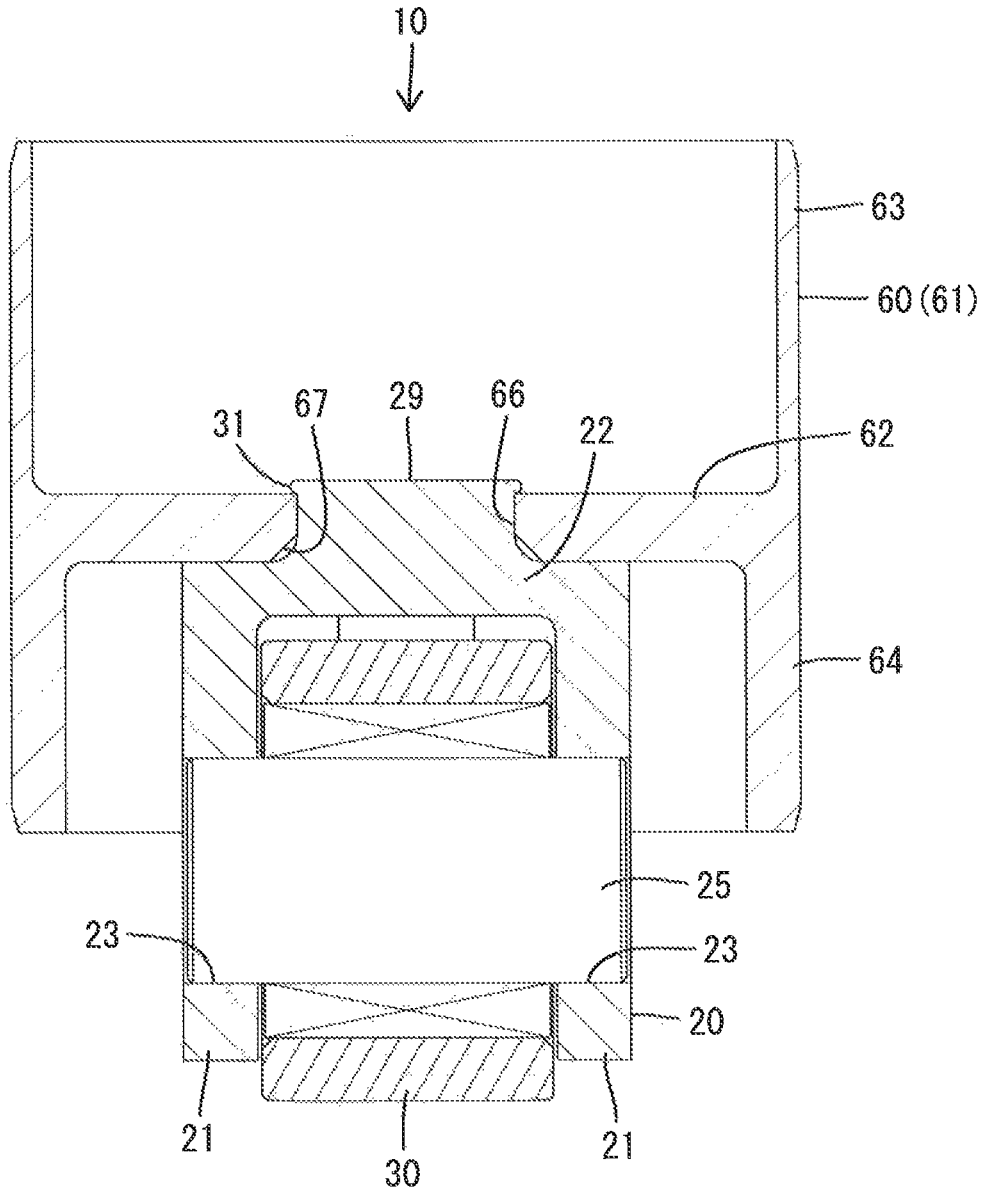
FIG. 2 is a sectional view taken along line A-A in FIG. 1.

The first member 20 is generally formed into the shape of an integrally continuous plate and includes a pair of opposed portions 21 which are opposed to each other so as to be substantially parallel to each other in a widthwise direction and a bridge portion 22 bridged between upper ends of the respective opposed portions 21, as shown in FIG. 2. Circular bearing holes 23 extend through the opposed portions 21 widthwise coaxially respectively. A columnar shaft 25 has both ends which are inserted through the bearing holes 23 of the opposed portions 21 to be fixed, respectively. The both ends of the shaft 25 have outer peripheries of end surfaces facing outsides of the opposed portions 21, respectively. The outer peripheries of the end surfaces are pressurized by a press thereby being swaged to be fixed to outer surfaces of the opposed portions 21 respectively, although the details are not shown in the drawings. In this embodiment, swaged portions to be crushed by the press are provided on a plurality of circumferentially spaced portions in the outer peripheries of the end surfaces of both ends of the shaft 25 respectively.

A roller 30 is rotatably supported via a rolling member 24 on the outer periphery of the shaft 25, as shown in FIG. 4. The roller 30 has an outer peripheral surface which is in contact with a cam 90.

Figure 7:
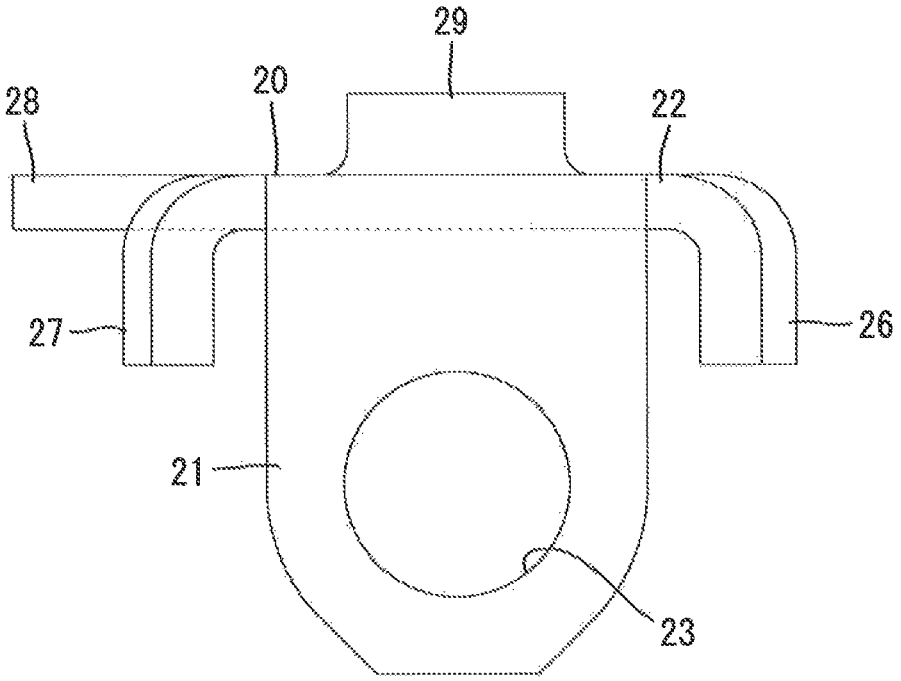
FIG. 7 is a side elevation of opposed portions and a bridge portion of a first member.

The bridge portion 22 is formed into the shape of a band plate extending in a front-back direction and has a rear end and a front end. The rear end has a rear drooping portion 26 which is downwardly bent to droop and has an arc-shaped section. The front end also has front drooping portions 27 each of which is downwardly bent to droop and has an arc-shaped section. As shown in FIG. 3, the front drooping portions 27 are paired at both sides of a frontwardly projecting projection 28 so that the projection 28 is interposed between the paired front drooping portions 27. The projection 28 is formed to be continuous to a body part of the bridge portion 22 except for the front and rear drooping portions 27 and 26 in a stepless manner linearly in the front-back direction, as shown in FIG. 7. The front and rear drooping portions 27 and 26 have outer peripheries having curvature radii substantially equal to that of an inner periphery of a cylindrical portion 61 which will be described later, respectively.

A columnar convex portion 29 is provided at an upper position on an upper surface of the bridge portion 22, which upper position is located above the roller 30 disposed between the opposed portions 21. An amount of protrusion of the convex portion 29 is limited to a level slightly larger than a wall thickness of a bottom wall 62 of the second member 60, which wall will be described later.

Figure 5:
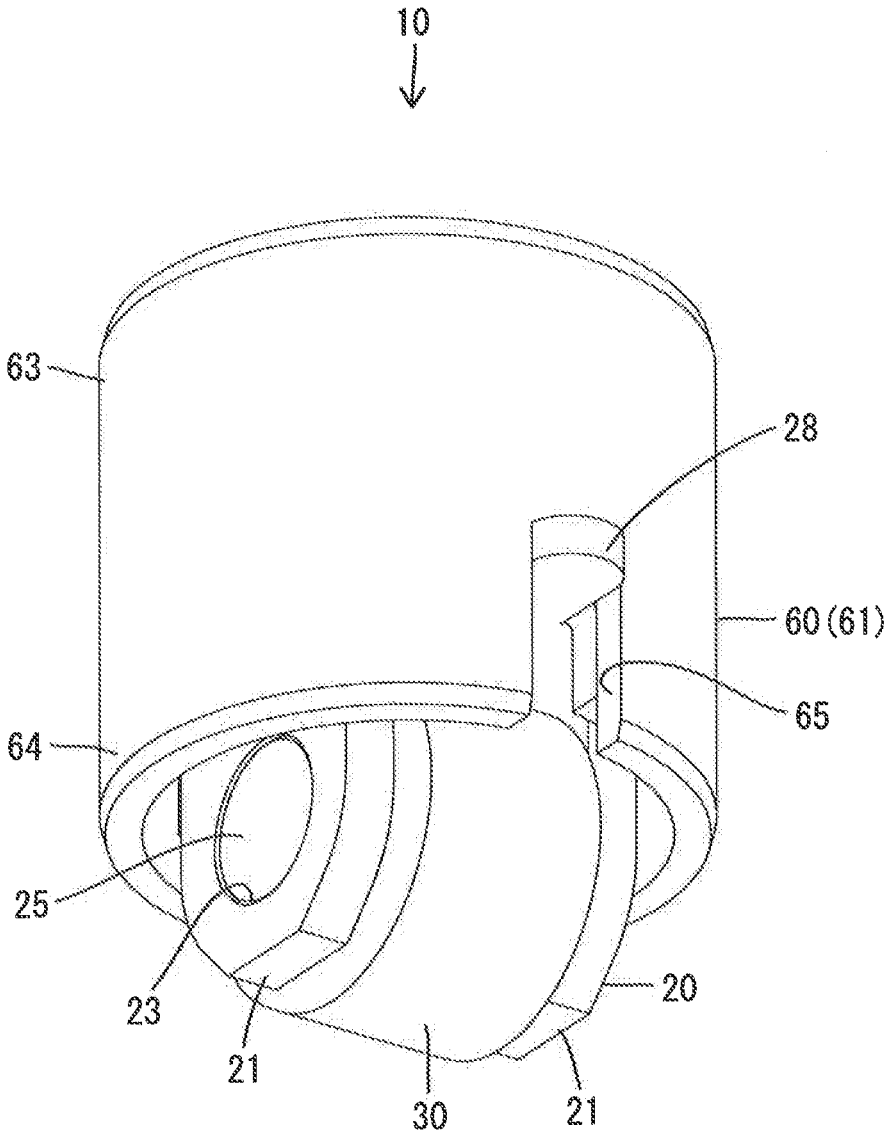
FIG. 5 is a perspective view of the roller lifter as viewed from below.
Figure 6:
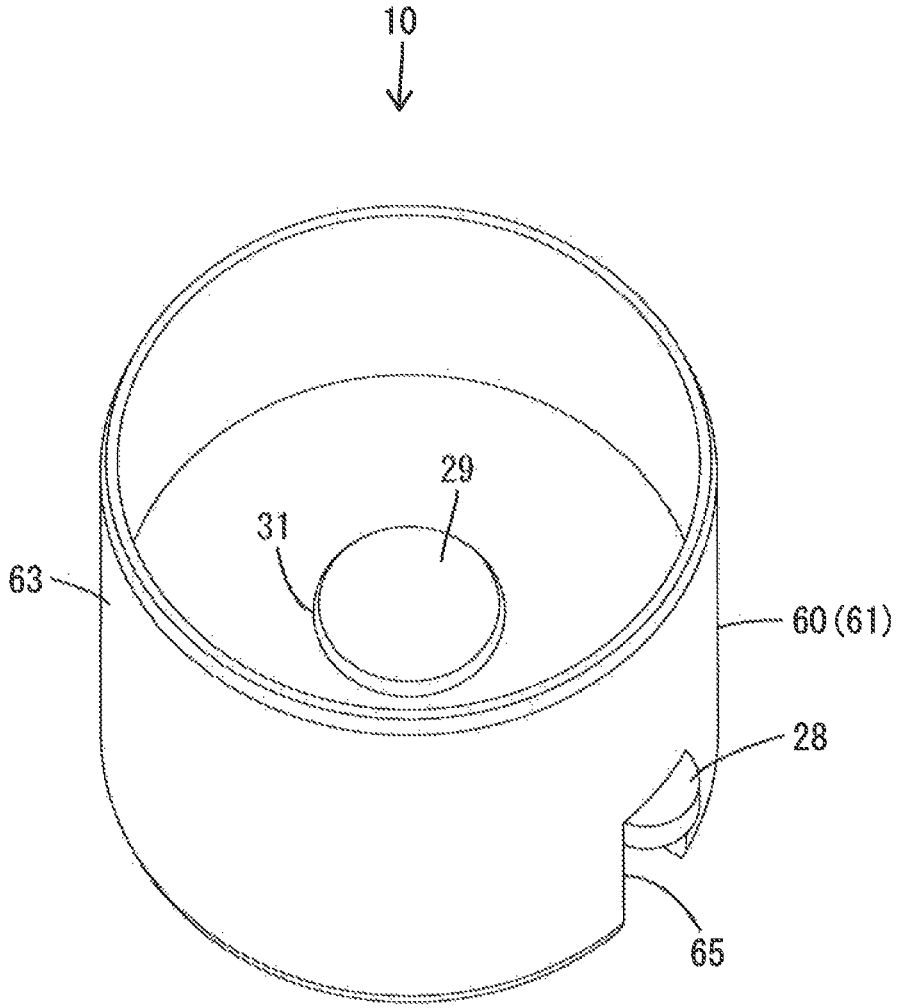
FIG. 6 is a perspective view of the roller lifter as viewed from above.
Figure 8:
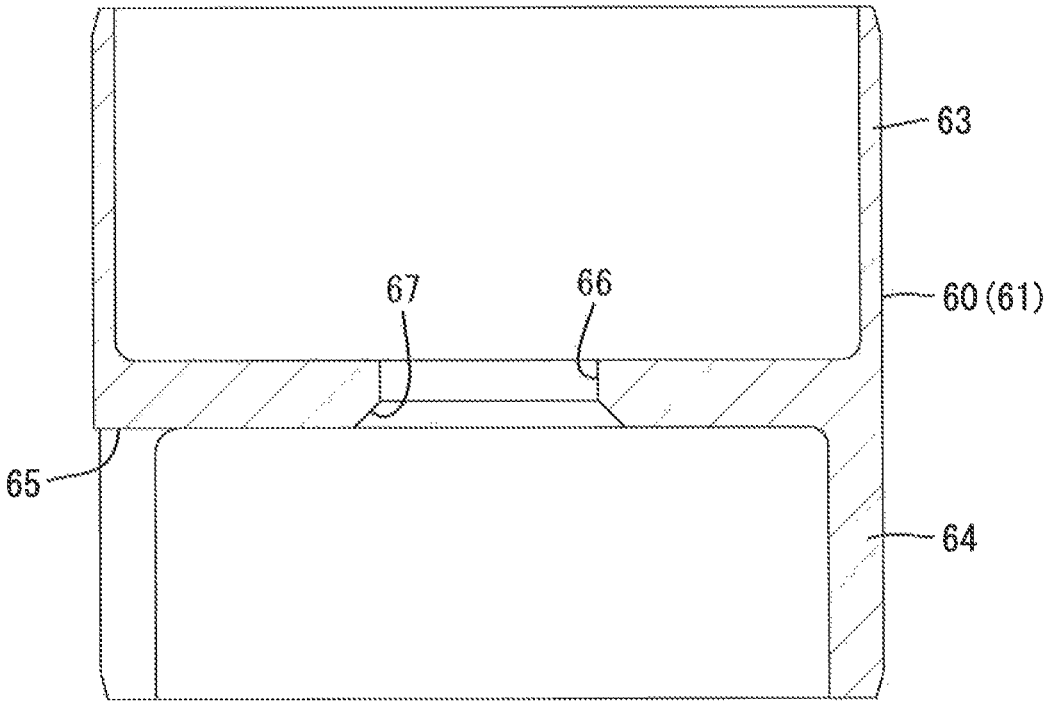
FIG. 8 is a sectional view of a second member as viewed sideways.

As shown in FIG. 8, the second member 60 generally comprises an integral cylindrical portion 61 and includes the disc-shaped bottom wall 62, a cylindrical peripheral wall 63 rising from an outer peripheral edge of the bottom wall 62 and a lower peripheral wall 64 extending downward from the outer peripheral edge of the bottom wall 62. The cylindrical portion 61 has an outer peripheral surface which is continuous from the peripheral wall 63 to the lower peripheral wall 64 over an entire height in a stepless manner, as shown in FIG. 5. Furthermore, the peripheral wall 63 has a slightly smaller thickness than the bottom wall 62 and the lower peripheral wall 64, as shown in FIG. 8.

The lower peripheral wall 64 includes a front part provided with a recess 65. The recess 65 is formed to have a substantially rectangular opening extending from a height position that is level with an underside of the bottom wall 62 to a lower end of the peripheral wall 63, as viewed at the front. The bottom wall 62 is provided with a circular hole 66 open at a central part of the bottom wall 62. An inverse tapered portion 67 having a diameter gradually increased toward the underside of the bottom wall 62 is provided at a lower part of the hole 66.

Next, a method of manufacturing the roller lifter 10 of the embodiment will be described. Prior to the assembly of the first member 20 to the second member 60, the shaft 25 is mounted to both opposed portions 21 of the first member 20. In this case, the roller 30 is previously supported on the shaft 25, and both ends of the shaft 25 are swaged thereby to be attached to the outer surfaces of the opposed portions 21 while both ends of the shaft 25 are fitted in the bearing holes 23 of the opposed portions 21, respectively.

Subsequently, the first member 20 is put inside the lower peripheral wall 64 of the cylindrical portion 61 from below. In the process of putting the first member 20 inside the second member 60, the projection 28 is inserted into the recess 65 to be fitted therein, and the front drooping portion 27 and the rear drooping portion 26 are slid on an inner periphery of the lower peripheral wall 64, whereby the first member 20 is inserted into the second member 60 to be positioned in a normal posture. Furthermore, the convex portion 29 is guided by the inverse tapered portion 67 to be fitted into the hole 66.

When the first member 20 has normally been incorporated inside the lower peripheral wall 64, the first member 20 is disposed so that an upper surface of the bridge portion 22 abuts against the underside of the bottom wall 62 substantially in a face-to-face contact state and so that the convex portion 29 is inserted through the hole 66 with a distal end thereof projecting above an upper surface of the bottom wall 62. Subsequently, as shown in FIGS. 2 and 4, the distal end of the convex portion 29 is pressed by a press thereby to be bulged, and a flange 31 formed over an entire circumference in the distal end of the convex portion 29 is secured to the upper surface of the bottom wall 62. Thus, the bottom wall 62 is tightly held between the flange 31 and the bridge portion 22 when the convex portion 29 is fitted into the hole 66 and then swaged to be fixed, with the result that the first member 20 is coupled to the second member 60 in a retained state. In this case, the projection 28 is fitted into the recess 65, whereby the first member 20 is circumferentially positioned relative to the cylindrical portion 61 with the result that the first member 20 is prevented from rotation about the hole 66. As shown in FIG. 1, when the first member 20 is mounted to the second member 60, the roller 30 is disposed while a substantially lower half thereof is exposed from a lower end of the lower peripheral wall 64 of the cylindrical portion 61.

When both ends of the shaft 25 are swaged to be fixed to the respective opposed portions 21, the opposed portions would sometimes fall inward so as to come closer to each other since outer surfaces of the opposed portions 21 are subjected to high pressure. In the embodiment, however, even if both opposed portions 21 are deformed during the swaging, the influences of the deformation of the opposed portions 21 do not reach the cylindrical portion 61, since the first member 20 can be mounted to the second member 60 after the shaft 25 has been fixed to the opposed portions 21. Accordingly, the outer periphery of the cylindrical portion 61 is maintained in a proper dimensional accuracy.

Figure 9:
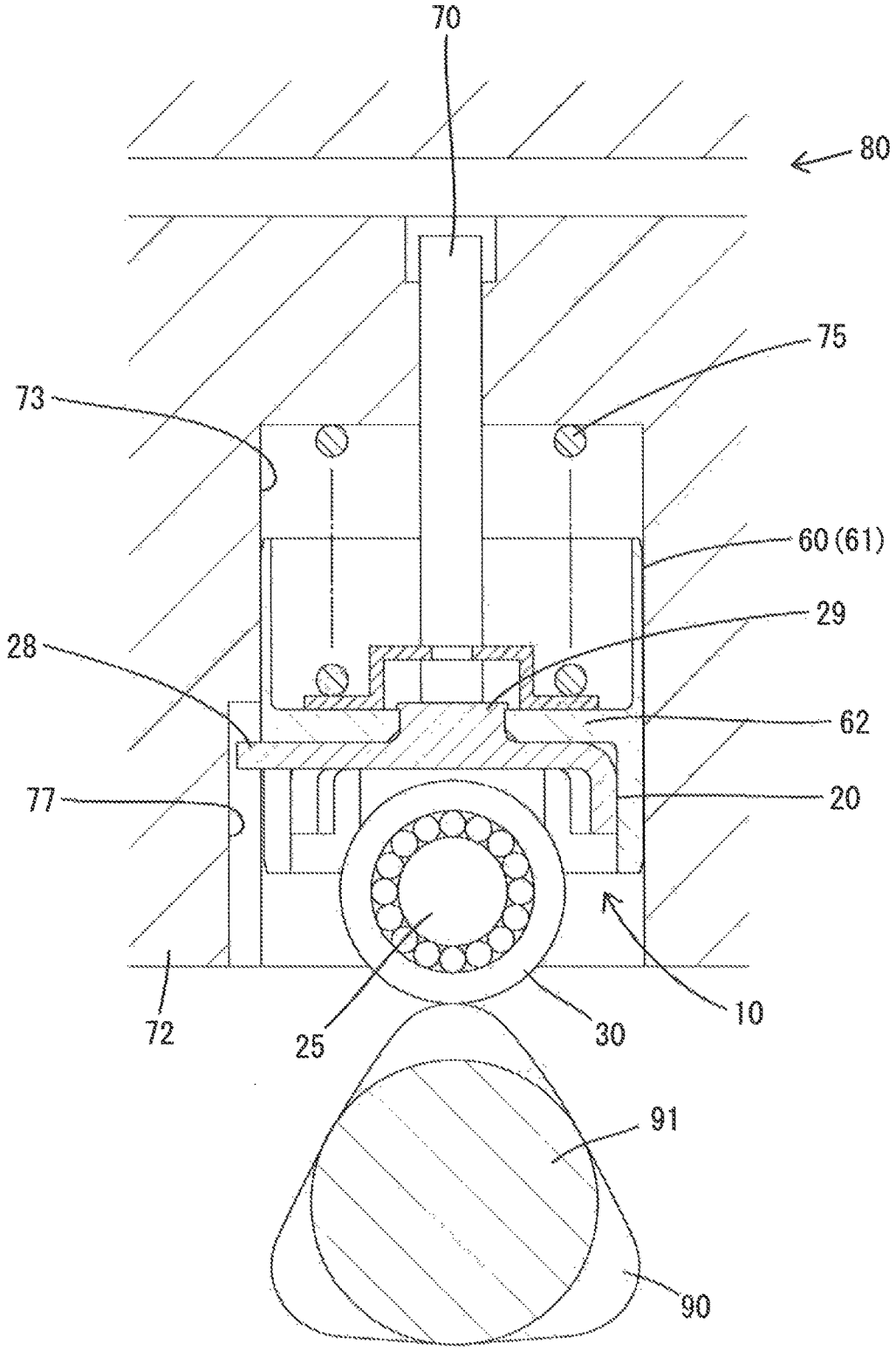
FIG. 9 is a schematic view of a fuel supply system into which the roller lifter is incorporated.

Thereafter, the roller lifter 10 is incorporated into the fuel supply system 80 as shown in FIG. 9. In this case, a driven member 70 such as a plunger is inserted into the peripheral wall 63 of the cylindrical portion 61 from above, and the cylindrical portion 61 is fitted into a sliding hole 73 of a cylinder head 72, so that the cam 90 provided on a cam shaft 91 is brought into contact with the roller 30 from below. A lower end of the driven member 70 is caused to abut against a flat distal end of the convex portion 29 facing the upper surface of the bottom wall 62. Furthermore, the driven member 70 is biased downward (to the side where the cam 90 is located) by an elastic member 75 such as a coil spring.

Upon rotation of the cam 90 in the above-described construction, the cylindrical portion 61 is reciprocated in the up-down direction by a stroke volume according to an amount of lift of the cam 90, and the driven member 70 is also reciprocated in the up-down direction. Thus, the reciprocal drive of the driven member 70 force-feeds an operating oil.

The outer periphery of the cylindrical portion 61 is slid on an inner periphery of the sliding hole 73 when the cylindrical portion 61 is reciprocated in the sliding hole 73 of the cylinder head 72. This requires a high processing accuracy in regard to the outer periphery of the cylindrical portion 61. In the embodiment, the roller lifter 10 has a split structure including the first member 20 and the second member 60 in order that influences of deformation of both opposed portions during the swaging of the shaft 25 may be prevented from reaching the cylindrical portion 61. This is of great significance. The distal end of the projection 28 projecting from the recess 65 of the cylindrical portion 61 is slidably fitted in a guide groove 77 annexed to the sliding hole 73 when the cylindrical portion 61 is reciprocated in the sliding hole 73 of the cylinder head 72, whereby the cylindrical portion 61 is prevented from rotation about an axis in the sliding hole 73.

According to the above-described embodiment, the first member 20 is coupled to the second member 60 (the cylindrical portion 61) with the shaft 25 being swaged to be fixed to the paired opposed portions 21, with the result that the outer diameter of the cylindrical portion 61 can be maintained in a proper dimensional accuracy without influences of the swaging of the shaft 25 reaching the cylindrical portion 61.

Furthermore, when the convex portion 29 is inserted through the hole 66 and swaged to be fixed to the bottom wall 62, the influences of the swaging do not directly reach the cylindrical portion 61 since the convex portion 29 is provided on the bridge portion 22 of the first member 20 and the hole 66 is provided in the bottom wall 62 of the cylindrical portion 61, with the result that the outer diameter of the cylindrical portion 61 can be maintained in a proper dimensional accuracy. Furthermore, since the convex portion 29 is swaged to be fixed to the bottom wall 62, the manufacture of the roller lifter can be rendered easier and the integrity of the first and second members 20 and 60 can be improved.

Additionally, since the convex portion 29 is provided on the bridge portion 22 and the hole 66 is provided in the bottom wall 62, the distal end of the convex portion 29 is caused to escape above the bottom wall 62 and the convex portion 29 is avoided from interference with another part such as the roller 30. This improves the freedom in design.

<Second Embodiment>

Figure 10:
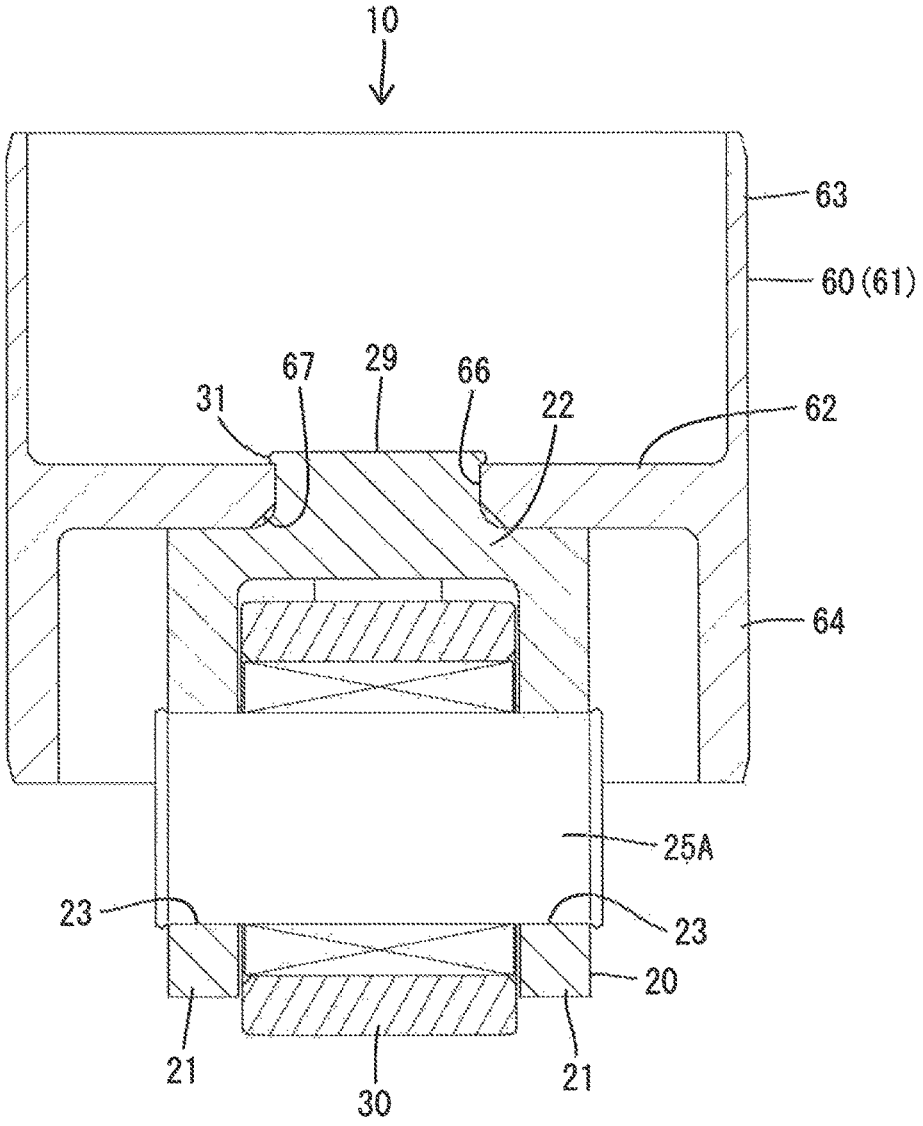
FIG. 10 is a view similar to FIG. 2, showing a second embodiment according to the present invention.
Figure 11:
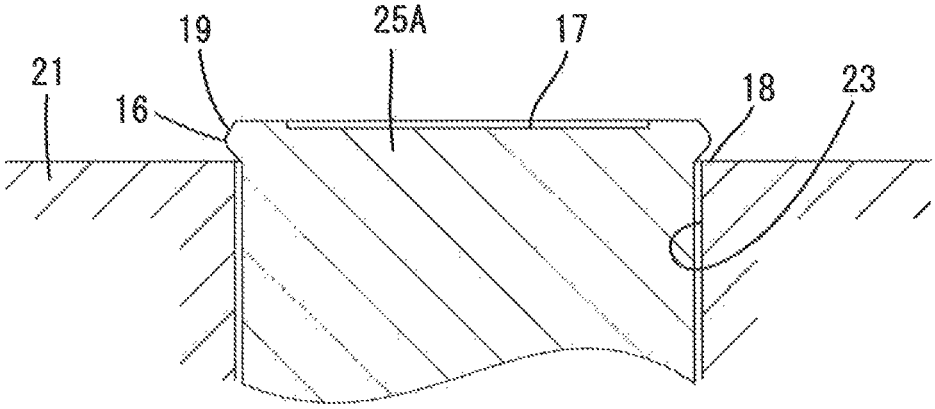
FIG. 11 is an enlarged sectional view showing an retaining portion protruding so as to face a surrounding portion of a bearing hole in outer surfaces of the opposed portions.

FIGS. 10 and 11 illustrate a second embodiment of the present invention. The second embodiment differs from the first embodiment in that both ends of the shaft 25A are not swaged to be fixed to the outer surfaces of the opposed portions 21 and are slidably inserted into the bearing holes 23 of the opposed portions 21. However, the first and second members 20 and 60 have the same structures as those in the first embodiment respectively. Accordingly, the structures common to the first and second embodiments are labeled by the same reference symbols as those in the first embodiment and duplicate explanations will be eliminated in the following description.

The shaft 25A is rotatably supported via the bearing holes 23 by the opposed portions 21. Both ends of the shaft 25A are provided with retaining portions 19 which protrude so as to face surrounding portions 18 of the bearing holes 23 in the outer surfaces of the opposed portions 21 and are capable of being caught on the surrounding portions 18 of the bearing holes 23, respectively.

The retaining portions 19 are formed by an upsetting process in which forces are imparted to annular protruding portions axially protruding from outer peripheries of the end surfaces (the axial end surfaces of the shaft 25A) of the shaft 25A respectively. More specifically, the retaining portions 19 are pressed thereby to be deformed so as to protrude outward in a radial direction which intersects with an axial direction on an outer circumference of the shaft 25A, with the result that protrusions 16 having substantially triangular sections are formed at outer circumferential sides, respectively, as shown in FIG. 11. The protrusions 16 are disposed in proximity to the surrounding portions 18 of the bearing holes 23 in the outer surfaces of the opposed portions 21 so as to be abuttable against the opening edges of the surrounding portions 18, respectively. Accordingly, when the shaft 25A is about to displace in a direction such that the shaft 25A drops out of the bearing holes 23, the protrusions 16 abut against the surrounding portions 18 of the bearing holes 23 respectively, whereby the shaft 25A is prevented from dropping out of the bearing holes 23. Circular recesses 17 as viewed in a planar view are formed in end surfaces of the shaft 25A respectively. The circular recesses 17 are circumferentially defined by the retaining portions 19 in inner sides of the protrusions 19 respectively.

In the second embodiment, both ends of the shaft 25A are circumferentially slid on the inner peripheries of the bearing holes 23 of the opposed portions 21 according to the rotation of the roller 30 thereby to be rotationally displaced relative to the opposed portions 21, respectively. Accordingly, a load area of the shaft 25A continually changes circumferentially without being limited to a certain range. This can render the service lives of the shaft 25A and both opposed portions 21 longer. Furthermore, since both ends of the shaft 25A are not fixed by the swaging to the outer surfaces of the opposed portions 21, the opposed portions 21 can be prevented from deformation causing the opposed portions 21 to fall inward with the coupling positions to the bridge portions 22 serving as fulcrums, respectively. Consequently, the dimensional accuracy of the opposed portions 21 can also be improved in addition to that of the cylindrical portion 61.

<Third Embodiment>

Figure 12:
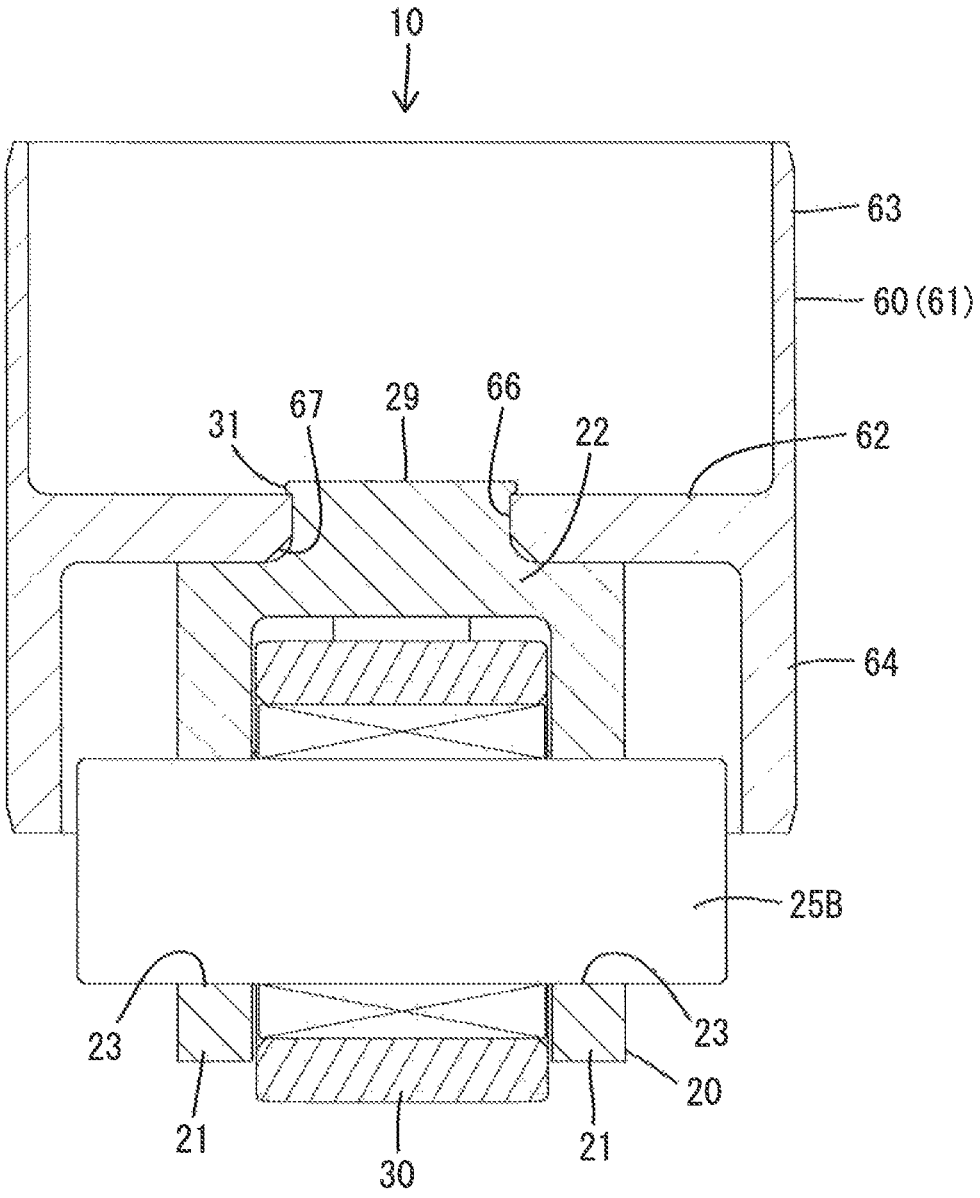
FIG. 12 is a view similar to FIG. 2, showing a third embodiment according to the present invention.

FIG. 12 illustrates a third embodiment of the present invention. The third embodiment is similar to the first embodiment in the structure of the first and second members 20 and 60 although also differing from the first embodiment in that both ends of the shaft 25B are not fixed by the swaging to the outer surfaces of the opposed portions 21.

The shaft 25B is formed into a columnar or cylindrical shape and extends substantially straight over an entire length that is an axial direction (a widthwise direction as viewed in FIG. 12). No process resulting in deformation of both ends of the shaft 25B is applied to the shaft 25B. The length of the shaft 25B is set to be slightly shorter than an inner diameter of the lower peripheral wall 64 of the cylindrical portion 61.

In assembly, the shaft 25B formed as described above is inserted through the first member 20 in a single state so as to be coaxial with the bearing holes 23 of the opposed portions 21. Then, after having been inserted through the respective bearing holes 23, both ends of the shaft 25B are disposed so as to substantially horizontally project outwards from the outer surfaces of the opposed portions 21.

Subsequently, the first member 20 is inserted inside the lower peripheral wall 64 of the cylindrical portion 61 from below and thereafter, the convex portion 29 having been inserted through the hole 66 is swaged to be fixed to the bottom wall 62. The first member 20 is thus coupled to be fixed to the second member 60. The third embodiment is similar to the first embodiment in this respect.

In the third embodiment, the first member 20 is inserted inside the lower peripheral wall 64 of the cylindrical portion 61, whereby both end surfaces of the shaft 25B (both axial end surfaces of the shaft 25B) are disposed in proximity to the inner periphery of the lower peripheral wall 64 so as to be abuttable against the inner periphery of the lower peripheral wall 64. Accordingly, when the shaft 25B is about to displace in a direction such that the shaft 25B drops out of the bearing holes 23 (in the widthwise direction as viewed in FIG. 12), the end surface of the shaft 25B abuts against the lower peripheral wall 64 from inside, with the result that the shaft 25B is prevented from dropping out of the bearing holes 23. Hence, according to the third embodiment, the shaft 25B can be inserted through the bearing holes 23 of the opposed portions 21 without any special processing to be applied to the shaft 25B. Furthermore, the opposed portions 21 can be maintained in a good dimensional accuracy since both ends of the shaft 25B are not fixed by the swaging to the outer surfaces of the opposed portions 21 as in the second embodiment. Additionally, although the shaft 25B is slidably inserted into the bearing holes 23 of the opposed portions 21 thereby to be rotatable relative to the opposed portions 21 as in the second embodiment, the shaft 25B may be press-fitted into the bearing holes 23 thereby to be substantially nonrotatable relative to the opposed portions 21.

<Other Embodiments>

The present invention should not be limited by the embodiments described above with reference to the drawings. The technical scope of the present invention encompasses the following embodiments, for example.

(1) One of known coupling means may be employed as the coupling portions intercoupling the first and second members, and the coupling portions should not be limited by the foregoing embodiments. For example, the first and second members may merely be welded together to be fixed. Furthermore, the first and second members may be intercoupled by bending a projecting piece. Still furthermore, the first and second members may not rigidly be fixed together and may be fixed together via an elastic holding means so that the integrity of the first and second members can be retained.

(2) The convex portion may be provided on the bottom wall and the hole may be provided in the bridge portion, contrary to the foregoing embodiments.

(3) The second member may be constructed to include a part other than the cylindrical portion. Furthermore, the first member may be constructed to include a part other than the paired opposed portions and the bridge portion.

(4) In the second embodiment, a plurality of retaining portions may be provided on the end surface of the shaft at circumferential intervals.

(5) In the third embodiment, the end surfaces of the shaft may be caused to abut against the inner periphery of the lower peripheral wall of the cylindrical portion thereby to be fixed thereto.

(6) The present invention is applicable to a valve lifter provided in a valve gear.

EXPLANATION OF REFERENCE SYMBOLS

10 . . . roller lifter;
18 . . . surrounding portions (of bearing holes);
20 . . . first member;
21 . . . opposed portions;
22 . . . bridge portion;
23 . . . bearing holes;
25, 25A, 25B . . . shaft;
29 . . . convex portion;
30 . . . roller;
60 . . . second member;
61 . . . cylindrical portion;
62 . . . bottom wall;
63 . . . peripheral wall; and
66 . . . hole

The invention claimed is:

1. A roller lifter which includes a roller brought into contact with a cam, a shaft rotatably supporting the roller, a pair of opposed portions through which both ends of the shaft are inserted respectively, the pair of opposed portions being opposed to each other in a right-left direction, and a cylindrical portion disposed to be fixed at a relative position to the opposed portions, wherein the cam is rotated so that the cylindrical portion is reciprocated via the roller, the roller lifter comprising:

a first member including at least the pair of opposed portions; and a second member separate from the first member and couplable via a coupling portion to the first member, the second member including at least the cylindrical portion, wherein:

the first member includes a bridge portion constructed between upper ends of the pair of opposed portions, the bridge portion having a front end and a rear end to both of which a front drooping portion and a rear drooping portion are bendingly continuous, respectively, the first member being inserted into the cylindrical portion in a normal posture while the front drooping portion and the rear drooping portion are in abutment against an inner periphery of the cylindrical portion;

a pair of the front drooping portions are provided at both sides of a frontwardly projecting projection so that the projection is interposed between the pair of front drooping portions, the projection being formed to be continuous to the bridge portion in a stepless manner linearly in a front-back direction; and the cylindrical portion includes a front part provided with a recess open in a lower end of the cylindrical portion, the projection being fitted in the recess.

2. The roller lifter according to claim 1, wherein:

the cylindrical portion has a bottom wall and a peripheral wall rising from an outer periphery of the bottom wall; and the coupling portion includes a convex portion provided on either one of the bridge portion and the bottom wall and a hole provided in the other of the bridge portion and the bottom wall, the convex portion being inserted through the hole and swaged thereby to be fixed to the other of the bridge portion and the bottom wall.

3. The roller lifter according to claim 2, wherein the convex portion is provided on the bridge portion and the hole is provided in the bottom wall.

4. The roller lifter according to claim 1, wherein:

the pair of opposed portions are provided with respective bearing holes, and the both ends of the shaft are slidably inserted into the respective bearing holes so that the shaft is rotatably supported by the opposed portions; and retaining portions are provided on outer peripheries of both end surfaces of the shaft respectively, the retaining portions protruding so as to face the surrounding portions of the bearing holes respectively.

5. The roller lifter according to claim 1, wherein:

the pair of opposed portions are provided with respective bearing holes, and the both ends of the shaft are disposed so as to project outside the pair of opposed portions after having been inserted through the bearing holes, respectively; and the both end surfaces of the shaft are located to be abuttable against an inner periphery of the cylindrical portion when the first member and the second member are coupled to each other.

* * * * *